US007799979B2

(12) United States Patent
Swartz

(10) Patent No.: US 7,799,979 B2
(45) Date of Patent: Sep. 21, 2010

(54) PLECTRUM MOUNTING APPARATUS AND METHOD OF USE

(76) Inventor: Patrick Neil Swartz, 31907 Calle El Potrero, Pauma Valley, CA (US) 92061

( * ) Notice: Subject to any disclaimer, the term of this patent is extended or adjusted under 35 U.S.C. 154(b) by 5 days.

(21) Appl. No.: 12/274,354

(22) Filed: Nov. 20, 2008

(65) Prior Publication Data

US 2010/0180747 A1 Jul. 22, 2010

(51) Int. Cl.
*G10D 3/16* (2006.01)

(52) U.S. Cl. ..... 84/322; 84/329

(58) Field of Classification Search ..... 84/322, 84/329

See application file for complete search history.

(56) References Cited

U.S. PATENT DOCUMENTS

| | | | | | |
|---|---|---|---|---|---|
| 557,293 | A | * | 3/1896 | Wahl | 84/322 |
| 1,128,084 | A | * | 2/1915 | Wilcoxon | 63/15.7 |
| 1,712,171 | A | * | 5/1929 | Rochas | 63/29.1 |
| 2,242,394 | A | * | 5/1941 | Harriss | 431/149 |
| 2,776,592 | A | * | 1/1957 | Di Preta | 84/322 |
| 3,218,826 | A | * | 11/1965 | De Santo | 63/15.6 |
| 3,442,169 | A | * | 5/1969 | Bowers | 84/322 |
| 3,465,544 | A | * | 9/1969 | Tucker | 63/15.6 |
| 3,789,720 | A | * | 2/1974 | McIntyre | 84/322 |
| 4,067,255 | A | * | 1/1978 | Camaioni | 84/322 |
| 4,137,814 | A | * | 2/1979 | Rowley | 84/322 |
| 4,236,384 | A | * | 12/1980 | Daub | 63/7 |
| 4,270,433 | A | * | 6/1981 | Adamec | 84/322 |
| 4,489,867 | A | * | 12/1984 | Schwemberger | 224/222 |
| 4,497,237 | A | | 2/1985 | Beall | |
| D291,809 | S | * | 9/1987 | Jasper | D17/20 |
| 4,711,150 | A | | 12/1987 | Hyduck | |
| 4,741,239 | A | | 5/1988 | Crafton | |
| 4,804,122 | A | * | 2/1989 | Knox | 224/220 |
| 4,982,641 | A | * | 1/1991 | Duhart | 84/329 |
| 4,993,302 | A | | 2/1991 | Jonathan | |
| 5,194,680 | A | | 3/1993 | Reineck | |
| 5,341,715 | A | | 8/1994 | Hucek | |
| 5,413,020 | A | * | 5/1995 | Thompson | 84/329 |
| D362,264 | S | * | 9/1995 | Trees | D17/20 |
| 5,610,349 | A | | 3/1997 | Fogarty | |
| D397,716 | S | * | 9/1998 | Mulkins | D17/20 |
| D397,717 | S | * | 9/1998 | Mulkins | D17/20 |

(Continued)

OTHER PUBLICATIONS

Jamkat Pick Holder Spring Loaded Guitar Plectrum, viewed May 6, 2010 @ http://cgi.ebay.co.uk/NEW-JAMKAT-PICK-HOLDER-SPRING-LOADED-GUITAR-PLECTRUM-/390181211950, the disclosure is not prior art and discloses the applcant's invention.*

(Continued)

*Primary Examiner*—Jeffrey Donels
*Assistant Examiner*—Robert W Horn

(57) ABSTRACT

According to an embodiment, a plectrum apparatus comprises a ring capable of being releasably mounted to a user's finger, and a harness capable of releasably securing a plectrum, the harness being hingedly coupled to the ring. In one embodiment, a first spring is further provided and configured to bias the harness in a stowed position. A plectrum secured to the harness may be positioned toward a thumb side of the user's finger in the stowed position when the ring is mounted on the user's finger. The harness may be further capable of being retracted in a deployed position, the plectrum secured to the harness engaged between the user's finger and thumb.

17 Claims, 4 Drawing Sheets

U.S. PATENT DOCUMENTS

| | | | | | |
|---|---|---|---|---|---|
| D397,718 | S | * | 9/1998 | Mulkins | D17/20 |
| 5,837,913 | A | * | 11/1998 | Newman | 84/329 |
| 5,837,916 | A | | 11/1998 | Newman | |
| 5,864,075 | A | | 1/1999 | Mapson | |
| 5,894,097 | A | | 4/1999 | Barry | |
| 5,973,243 | A | | 10/1999 | Christenson | |
| 6,011,206 | A | | 1/2000 | Straley | |
| 6,054,643 | A | | 4/2000 | Chance et al. | |
| 6,118,058 | A | * | 9/2000 | Rowley | 84/320 |
| 6,127,613 | A | * | 10/2000 | Hansel | 84/332 |
| 6,242,677 | B1 | | 6/2001 | Sander | |
| 6,472,590 | B1 | | 10/2002 | Kulik | |
| 6,568,214 | B2 | * | 5/2003 | Wolff | 63/29.1 |
| 6,701,746 | B1 | * | 3/2004 | Bentley | 63/15 |
| 6,977,330 | B2 | * | 12/2005 | Santa Cruz et al. | 84/322 |
| 7,017,368 | B2 | * | 3/2006 | Hug | 63/7 |
| 7,435,889 | B1 | * | 10/2008 | Heidt | 84/422.4 |
| 2003/0047058 | A1 | * | 3/2003 | Pearson-Bey | 84/322 |
| 2006/0117931 | A1 | * | 6/2006 | Benyahia et al. | 84/322 |
| 2009/0139384 | A1 | * | 6/2009 | Bramucci | 84/322 |
| 2009/0217497 | A1 | * | 9/2009 | Lans | 24/499 |
| 2009/0229442 | A1 | * | 9/2009 | Hollin, Jr. | 84/322 |

OTHER PUBLICATIONS

The Jam Kat Anthology, viewed May 6, 2010 at http://www.pick-smith.com/jamkat.html © 2008-2009, the applicant's web page describing the claimed invention. The disclosure is not prior art.*

* cited by examiner

PLECTRUM MOUNTING APPARATUS AND METHOD OF USE

TECHNICAL FIELD

The present invention is directed to musical instruments, and, more particularly, to a plectrum mounting apparatus for users of strings musical instruments.

BACKGROUND

A plectrum, also referred to as a "plec," "pick" or "flat-pick," is a small, typically flat tool used to pluck or strum a stringed musical instrument. For guitars, banjos and similar instruments, the plectrum is a separate tool held in the player's hand during use.

FIG. 1 illustrates an exemplary embodiment of a plectrum 100 in a typical triangular shape with rounded corners, although the size, shape and width of plectra vary considerably. The thickness, shape, and material used for forming the plectrum may be varied to accommodate user preferences for handling and/or to color the style of play. Plectra for guitars are made of a variety of materials, including celluloid, metal, and, in some cases, exotic materials such as stone, but plastic is the most common in recent times. For other instruments in the modern day most players use plastic plectra but a variety of other materials, including wood and felt (for use with the ukulele) are common.

In addition to playing a string musical instrument with a plectrum, users can also play the instrument directly, e.g., with the user's thumb and/or fingers without use of a tool. For guitar, play, for example, such style of play is commonly referred to as "finger-style" or "finger-picking" in contrast to the style of play involving use of a plectrum, which is often referred to as "flat-picking."

One challenge that has plagued users of stringed musical instruments for some time has been the inability to quickly and efficiently alternate between flat-picking and finger-style methods of play due to the inability of the plectrum to be readily stowed and retrieved in a timely and repeatable manner. Often players desiring to alternate between the two styles noted above resort to cumbersome techniques, such as discarding plectra after a period of use and retrieving another one from a dispenser when subsequently needed. Another common approach is to store the plectrum in the user's mouth when not needed. Both approaches have the disadvantage of requiring the user to move the playing hand away from the string area to engage in the storage and retrieval, which may negatively result in mistiming play. The former approach has the further disadvantage of requiring multiple picks to be readily available, requiring clean up, and requiring a dispenser proximately located to the user, which may limit the player's mobility. The latter approach may further introduce the player's saliva onto the plectrum which can be transferred to the strings of the instrument, resulting in early decay and deterioration of the strings.

Existing devices have been attempted to provide means for stowing and retrieving a plectrum during play. A common deficiency in existing plectrum holders, however, is that the plectrum is fixedly attached to the means for mounting the holder to the user's finger. As such, the angle between the plectrum and the player's finger is fixed, resulting in reduced flexibility of playing positions. Moreover, storage and retrieval often involves a cumbersome rotation of the mounting means. Furthermore, the plectrum body is not replaceable and is subject to wear and breakage. Examples of such attempts include U.S. Pat. No. 4,497,237 and U.S. Pat. No. 5,973,243. The device of U.S. Pat. No. 4,497,237 has additional shortcomings, including, for example, the rotation of the pick around the forefinger being unassisted and does not place the retracted pick in a position where it will not interfere with the strings when playing finger-style. Similarly, while U.S. Pat. No. 2,776,592 provides a means for pivotally connecting the plectrum relative to the mounting means, storage and retrieval is awkward. Moreover, the position of the plectrum in play mode is significantly compromised, being in a fixed plane normal to the axis.

Alternatively attempts for providing storage and retrieval of the plectrum have provided more range of movement for the plectrum with respect to means for fixing the holder to the user, but such attempts often require awkward movements for storage and/or retrieval. For example, U.S. Pat. No. 5,413,020 does not provide for a reliably repeatable retrieval of the pick, as the mechanism is attached to the wrist and is subject to varied motion relative to the hand and fingers used for retrieval. Furthermore, rotation of the pick cannot be controlled. At best, it would take thumb, forefinger and visual reference to retrieve the plectrum. The device is also cumbersome, extending from the wrist over the back of the hand. Likewise U.S. Pat. No. 5,837,913 stows the plectrum in a cavity within the user's hand. To avoid the plectrum interfering with the strings during finger-style play, one would require a learned contortion technique and modifications of the user's style of play. Indeed, the rotation of the stowed pick is not governed or otherwise indexed, resulting in visual reference and varied time intervals for retrieval.

Accordingly, there exist a strong need in the field for a plectrum mounting apparatus for readily stowing and retrieving a plectrum during play.

SUMMARY

Disclosed herein are various embodiments of plectrum apparatuses for use with stringed musical instruments. According to an embodiment, a plectrum apparatus comprises a ring capable of being releasably mounted to a user's finger, and a harness capable of releasably securing a plectrum, the harness being hingedly coupled to the ring. In one embodiment, a first spring is further provided and configured to bias the harness in a stowed position. A plectrum secured to the harness may be positioned toward a thumb side of the user's finger in the stowed position when the ring is mounted on the user's finger. The harness may be further capable of being retracted in a deployed position, the plectrum secured to the harness engaged between the user's finger and thumb.

According to one embodiment, the harness is hingedly coupled to the ring about an axis which is not parallel to a plane defined by the ring. For example, the harness may be hingedly coupled to the ring about an axis approximately thirty to sixty degrees relative to a plane defined by the ring.

According to one embodiment, the harness may comprise a first claw portion hingedly coupled to a second claw portion, and a spring biasing the first and second claw portions in a closed position. According to another embodiment, the ring may comprise a first arm portion hingedly coupled to a second arm portion, and a spring biasing the first and second arm portions in a closed position.

According to another embodiment, the harness member and the plectrum may be an integral unit, and may be considered a plectrum module. According to this particular embodiment, the plectrum apparatus comprises a ring capable of being releasably mounted to a user's finger, and a plectrum module, the plectrum module being hingedly coupled to the ring In one embodiment, a first spring is further provided and configured to bias the plectrum module in a stowed position. A plectrum component of the plectrum module may be positioned toward a thumb side of the user's finger in the stowed position when the ring is mounted on the user's finger. The plectrum module may be further capable of being retracted in a deployed position, the plectrum component of the plectrum module engaged between the user's finger and thumb.

In one embodiment, the plectrum module is hingedly coupled to the ring about an axis which is not parallel to a plane defined by the ring. For example, the plectrum module may be hingedly coupled to the ring about an axis approximately thirty to sixty degrees relative to a plane defined by the ring.

According to one embodiment, the ring may comprise a first arm portion hingedly coupled to a second arm portion, and a spring biasing the first and second arm portions in a closed position.

Other features and advantages of the present invention will become more readily apparent to those of ordinary skill in the art after reviewing the following detailed description and accompanying drawings.

DETAILED DESCRIPTION

Figure 2A:
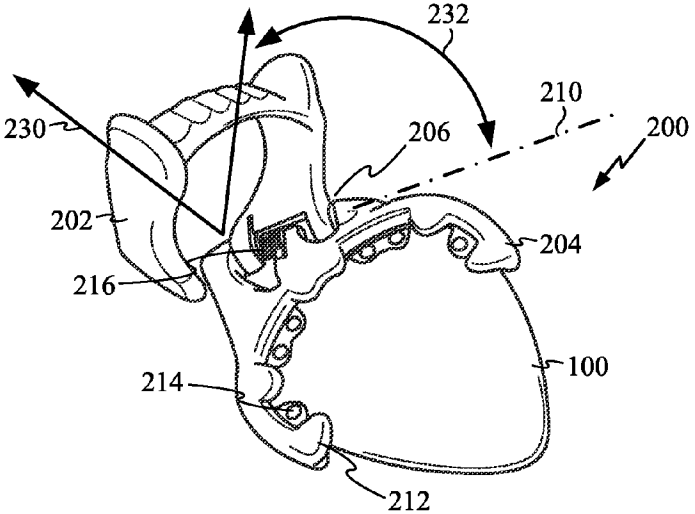
FIG. 2A depicts a perspective view of an exemplary plectrum mounting apparatus according to one embodiment.

Referring first to FIG. 2A, there is shown a perspective view of exemplary plectrum mounting apparatus 200 according to one embodiment. Plectrum mounting apparatus 200 includes ring member 202 capable of being releasably mounted to a user's finger (not shown). Apparatus 200 further comprises harness member 204 capable of releasably securing a plectrum, such as plectrum 100 shown in FIG. 2A. One end of ring member 202 includes an interface for hingedly coupling ring member 202 to harness member 204. As shown in FIG. 2A, the interface between ring member 202 and harness member 204 forms hinge 206 defined along axis 210.

Figure 2B:
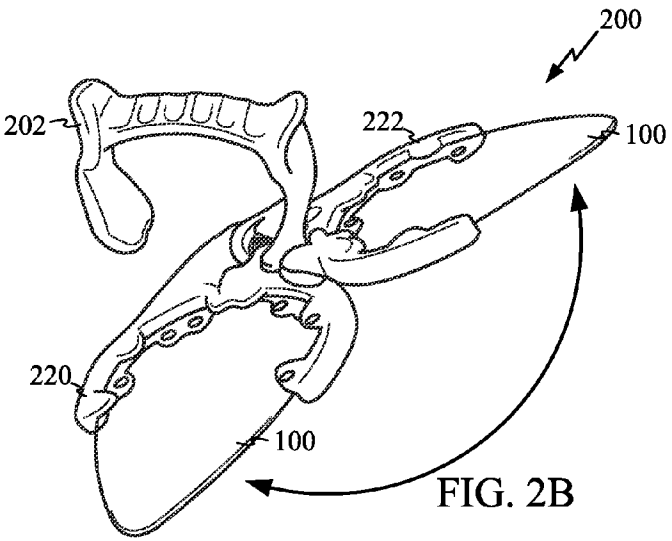
FIG. 2B depicts a perspective view of another exemplary plectrum mounting apparatus according to one embodiment.
Figure 1:
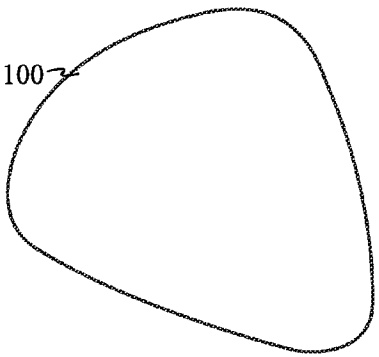
FIG. 1 depicts an exemplary embodiment of a plectrum according to one embodiment.

Referring to FIG. 2B, plectrum mounting apparatus 200 of FIG. 2A is shown according to another perspective view. In FIG. 2B, harness member 204 is shown in a first stowed position 220 and a second deployed position 222. As discussed above in conjunction with FIG. 2A, rotation of harness member 204 about axis 210 of hinge 206 allows the user to conveniently access plectrum 100 attached to harness member 204 to be accessed from the stowed position 220 and position plectrum 100 in deployed position 222 during play. According to one embodiment, plectrum 100 and harness member 204 are positioned in stowed position 220 for finger-style play of a stringed musical instrument, and plectrum 100 and harness member 204 are positioned in deployed position 222 for flat-picking style of play.

Referring again to FIGS. 2A and 2B, spring 216 biases harness member 204 in stowed position 220. As described in further detail below, the user engages plectrum 100 to position harness member 204 and plectrum 100 in deployed position 222. Since spring 216 biases harness member 204 in stowed position 220, stowed position 220 can be considered the rest position of harness member 204. When the user engages plectrum 100 to position harness member 204 and plectrum 100 in deployed position 222, e.g., during flat-picking style of play, the user can quickly return harness member 204 and plectrum 100 to stowed position 220 by simply releasing engagement of plectrum 100.

Ring member 202 defines plane 230 generally along its radial axis. According to one exemplary embodiment, hinge 206 is aligned such that axis 210 of hinge 206 is not parallel to plane 230 of ring member 202. According to one exemplary embodiment, hinge 206 is aligned such that axis 210 of hinge 206 is not perpendicular to plane 230 of ring member 202. According to one exemplary embodiment, hinge 206 is aligned such that axis 210 of hinge 206 is diagonally positioned or askew from plane 230 of ring member 202. For example, angle 232 defined between axis 210 and plane 230 may be between 20 degrees to 70 degrees. By varying the diagonal angle of axis 210 relative to plane 230, plectrum 100 can be positioned in a natural position or otherwise user-preferential position, when engaged by the user in deployed position 222 during flat-picking style of play or other active uses when engaging string play using plectrum 100.

Harness member 204 is capable of releasably securing a plectrum, such as plectrum 100. According to one embodiment, harness member 204 is made of flexible material, such as plastic or other composite material. Various means for releasably securing plectra may be employed. In one embodiment, plectrum may be sandwiched between shoulders 212 and 214 on opposing sides of harness member 204 as shown in FIG. 2A. According to one embodiment, and in order to further enhance security of plectrum within harness member 204, one or more pins extending from one or more of the shoulders 212 and/or 214 may engage corresponding apertures, cavities or indentures within plectrum 100 as depicted in FIG. 2A. Moreover, various sizes of such harness members may be utilized to accommodate various size, shapes, and thicknesses of plectra.

Referring now to FIGS. 3A through 3D, there is shown exemplary plectrum mounting apparatus 200, wherein the ring member is mounted to user's second phalange of the forefinger on the striking hand, i.e., the hand used for strumming or picking the strings of the instrument. While the plectrum mounting apparatus shown in various embodiments herein depict a striking hand comprising a right hand, it would be readily apparent to one skilled in the art having the benefit of the present disclosure that the plectrum mounting apparatus of the present invention is equally suitable for use with the left hand.

Figure 3A:
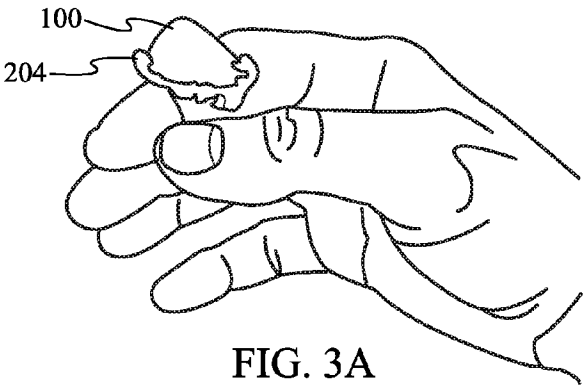
FIGS. 3A through 3D depict an exemplary plectrum mounting apparatus in various positions of deployment and/or stowage according to one embodiment.

In FIG. 3A, harness member 204 and plectrum 100 are disengaged by the user, and, as described above, are biased and retracted in stowed position 220. In stowed position 220, plectrum 110 attached to harness member 204 is positioned toward a thumb side of the user's finger. In stowed position 220, plectrum 100 does not negatively impact the user's ability to engage the instrument in a severe manner as in earlier solutions. Typically, little or no adjustment to finger-style play is required due to the strategic position of plectrum 100 in stowed position 220. Yet as described below access to plectrum 100 is facilitated and position of plectrum 100 is optimized.

Figure 3B:
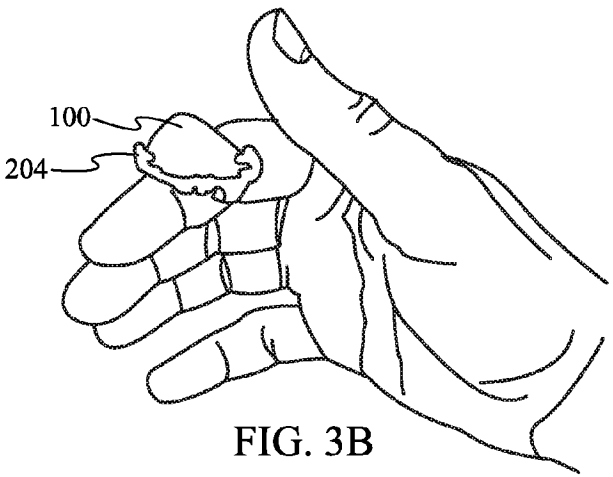
Figure 3C:
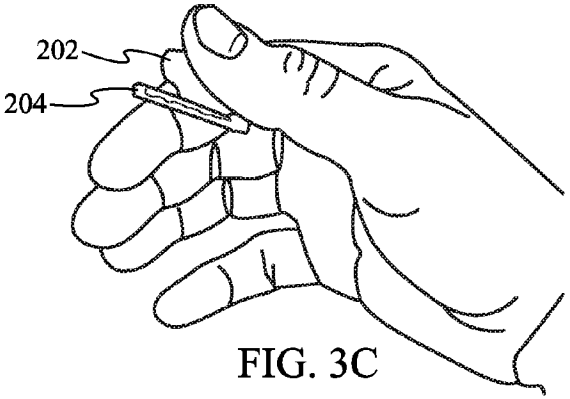

In FIG. 3B, user's thumb prepares to engage plectrum 100 on the surface facing away from the user palm by simply reaching around plectrum 100. In FIG. 3C, the user's thumb engages plectrum 100 and/or harness member 204 by pressing down, deflecting spring 216, and causing harness member 204 to rotate about hinge 206.

Figure 3D:
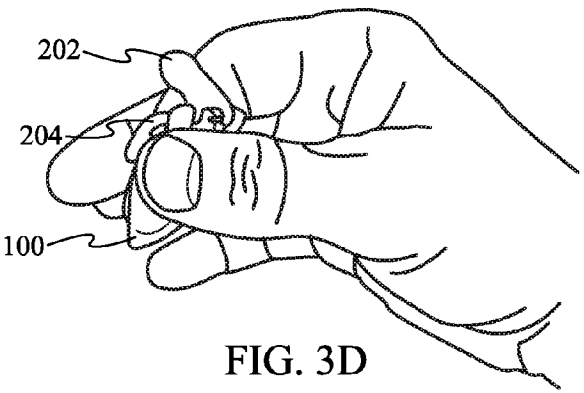

In FIG. 3D, the user's thumb and one or more fingers engage the plectrum 100 in deployed position 222. Due to the angular position of hinge 206 defined between ring member 202 and harness member 204 as described above, the position of plectrum 100 is in an ideal position or otherwise user-preferential position for flat-picking style of play. By moving the user's thumb laterally away from plectrum 100 and harness member 204, spring 216 biases plectrum 100 and harness member 204 back to stowed position 220, as depicted in FIG. 3A. Thus, plectrum mounting apparatus 200 readily facilitates alternating between various styles of play for stringed musical instruments. As illustrated by the above examples, the plectrum can be quickly accessed when desired for flat-picking style of play, and simply released to allow function of the user's digits for finger-style play. Furthermore, the stowed plectrum facilitates use of the dominant or striking hand for amp and/or instrument adjustment, operating a keyboard and/or mouse during computer based recording, answering a phone, etc. Moreover, the plectrum is less likely to be dropped or lost during performance.

Figure 4:
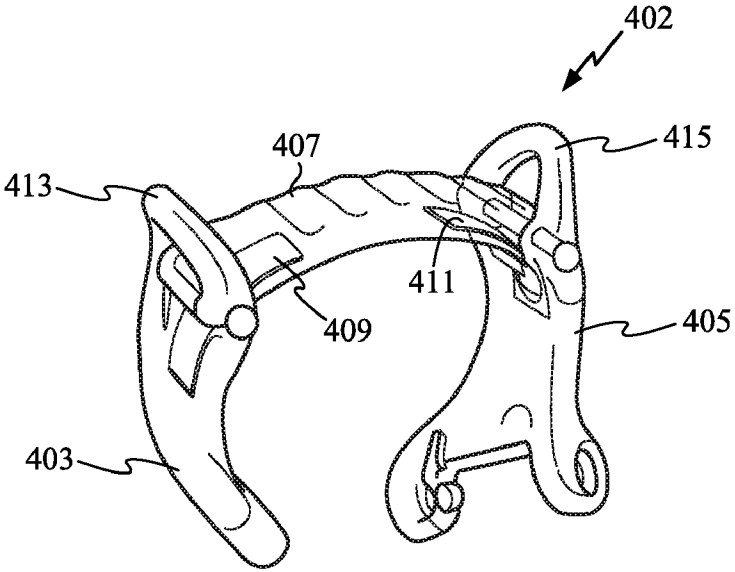
FIG. 4 depicts an exemplary ring member according to another embodiment.

Referring now to FIG. 4, there is shown exemplary ring member 402 according to another embodiment. Like ring member 202 discussed above, ring member 402 is capable of being releasably mounted to a user's finger and for forming a plectrum mounting apparatus according to the present invention. Ring member 402 comprises arm members 403 and 405, each hingedly coupled to body member 407. Spring 409 biases arm 403 against body 407 in a closed position, and spring 411 biases arm 405 against body 407 in a closed position. Ring member 402 clamps around a user's finger due to the biasing of springs 409 and 411. Ring member 402 is releasbly detached from a user's finger by deflecting the spring action. For example, arm extensions 413 and 415 of arms 403 and 405, respectively, may be engaged to deflect springs 409 and 411 to release ring member 402 from the user's finger. The embodiment associated with ring member 402 of FIG. 4 is particularly useful when employing rigid materials, such as metals and other materials having low flexure qualities. Moreover, it is noted that the embodiment of FIG. 4 is illustrative only, and other embodiments, such as those including fewer or more hinges are considered within the spirit and scope of the plectrum mounting apparatus disclosed herein.

Figure 5:
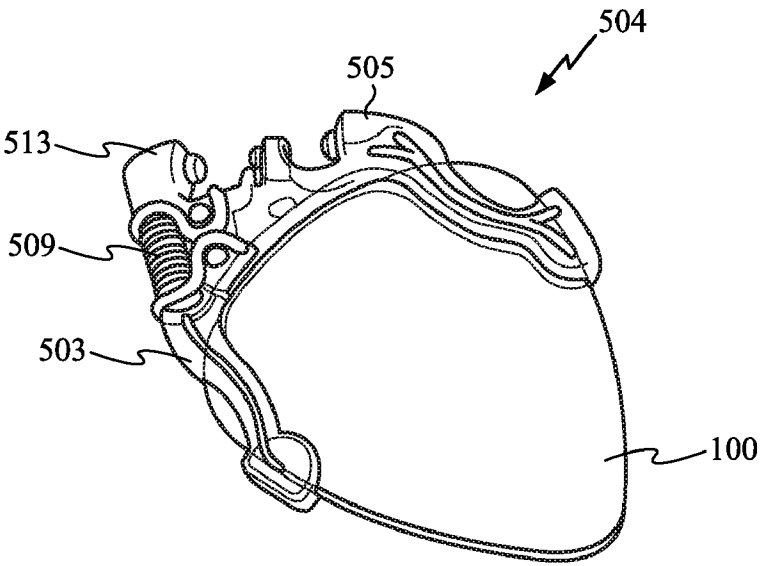
FIG. 5 depicts a harness ring member according to another embodiment.

Referring to FIG. 5, there is shown exemplary harness member 504 according to another embodiment. Like harness member 204 discussed above, harness member 504 is capable of being releasably mounted to a plectrum and for forming a plectrum mounting apparatus according to the present invention. Harness member 504 comprises claw members 503 and 505, hingedly coupled to each other. Spring 509 biases claw 503 against claw 505 in a closed position. Harness member 504 clamps around plectrum 100 due to the biasing of spring 509. Harness member 504 is releasbly detached from plectrum 100 by deflecting the spring action of spring 509. For example, release lever 513 may be engaged to deflect spring 509 to release plectrum 100 from harness member 504. The embodiment associated with harness member 504 of FIG. 5 is particularly useful when employing rigid materials, such as metals and other materials having low flexure qualities.

Figure 6:
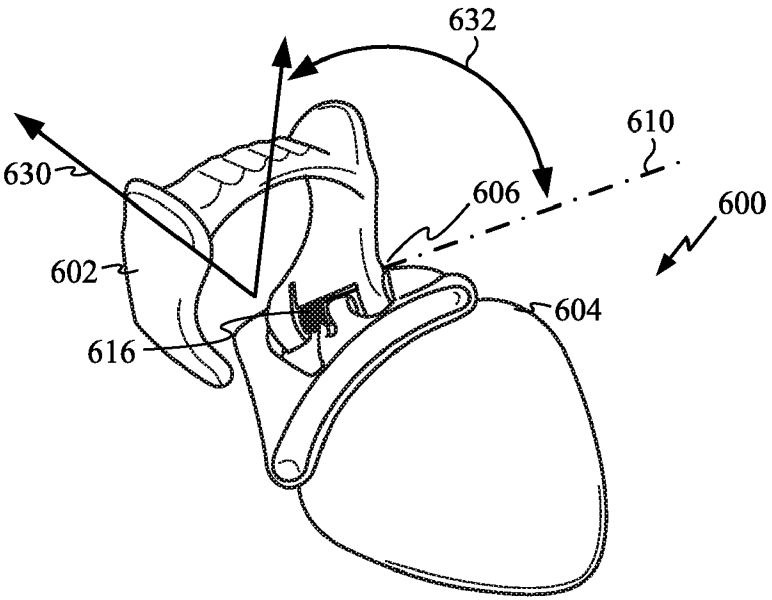
FIG. 6 depicts a perspective view of an exemplary plectrum apparatus according to one embodiment.

Referring now to FIG. 6, there is shown exemplary plectrum apparatus 600 according to one embodiment. In the embodiment of FIG. 6, the harness member and plectrum comprise integral unit 604. Ring member 602 is provided as described above, where ring member is hingedly coupled at 606 to integral harness/plectrum unit 604 to provide the ability to position the plectrum in the deployed and stowed position as described above. According to this particular embodiment, the plectrum in not releasably mounted to the harness member, in contrast to the embodiments previously described and depicted above. For purposes of the present disclosure, such an "integral harness/plectrum" may also be considered simply as a "plectrum module." Accordingly, the hinging means 606 couples the ring member to the plectrum module. Advantageously, fewer parts are needed, and manufacturing is simplified. However, the benefits of the plectrum apparatus allowing flexible playing positions for flatpicking and finger-style can still be provided as described above.

In particular, rotation of plectrum module 604 about axis 610 of hinge 606 allows the user to conveniently access plectrum module 604 to be accessed from a stowed position to place plectrum module 604 in a deployed position during play. As described above, spring 616 biases plectrum module 604 in the stowed position. The user can quickly return plectrum module 604 to the stowed position by simply releasing engagement of plectrum module 604.

Ring member 602 defines plane 630 generally along its radial axis. According to one exemplary embodiment, hinge 606 is aligned such that axis 610 of hinge 606 is not parallel to plane 330 of ring member 602. According to one exemplary embodiment, hinge 606 is aligned such that axis 610 of hinge 606 is not perpendicular to plane 630 of ring member 602. According to one exemplary embodiment, hinge 606 is aligned such that axis 610 of hinge 606 is diagonally positioned or askew from plane 630 of ring member 602. For example, angle 632 defined between axis 610 and plane 630 may be between 20 degrees to 70 degrees.

Figure 7A:
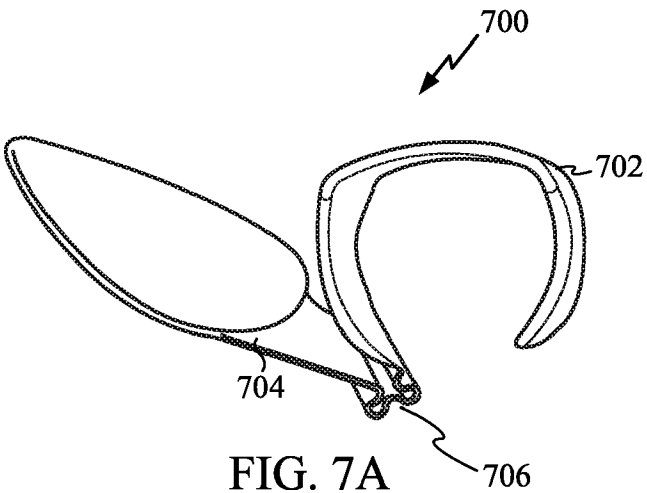
FIGS. 7A and 7B depict perspective views of another exemplary plectrum apparatus according to one embodiment.
Figure 7B:
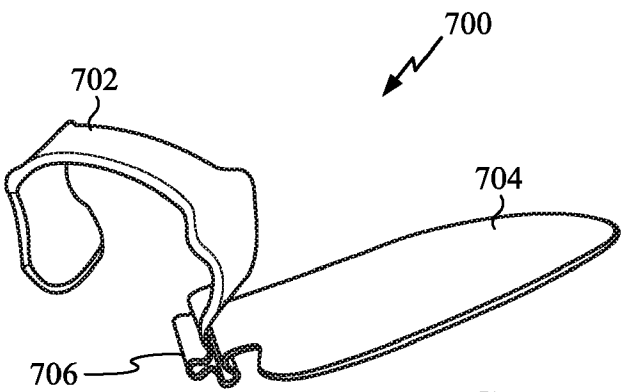

Referring now to FIGS. 7A and 7B, there are shown perspective views of another exemplary plectrum apparatus 700 according to one embodiment. Plectrum apparatus 700 comprises an integral unit comprising ring member 702 coupled to integral harness/plectrum unit 704 (plectrum module) about an integral hinging means. According to this particular embodiment, the hinging means coupling the ring member to the integral harness/plectrum unit comprises living hinge 706 and is materially integral with ring member 702 and plectrum module 704. Hinge 706 biases plectrum module 704 in a stowed position and allows deflection by the user to place plectrum module 704 in a deployed position as described above. Further, hinge 706 defines an axis which is diagonally askew from a plane defined the by the radial axis of ring member 702 in the manner as described above. Accordingly a single unit comprising a single material is provided, further reducing device complexity and manufacture.

The material used for forming the particular plectrum apparatus of FIGS. 7A and 7B typically has some level of flexure to provide the ability to position the plectrum in the deployed and stowed position as described above, thereby beneficially providing flexible playing positions for flatpicking and finger-style as described above.

From the above description of exemplary embodiments of the invention, it is manifest that various techniques can be used for implementing the concepts of the present invention without departing from its scope. Moreover, while the invention has been described with specific reference to certain embodiments, a person of ordinary skill in the art would recognize that changes could be made in form and detail without departing from the spirit and the scope of the invention. For example, while the plectrum mounting apparatus shown in various embodiments and described above depict a striking hand comprising a right hand, it would be readily apparent to one skilled in the art having the benefit of the present disclosure that the plectrum mounting apparatus of the present invention is equally suitable for use with the left hand. The described exemplary embodiments are to be considered in all respects as illustrative and not restrictive. It should also be understood that the invention is not limited to the particular exemplary embodiments described herein, but is capable of many rearrangements, modifications, and substitutions without departing from the scope of the invention.

What is claimed is:

1. An apparatus comprising:

a ring capable of being releasably mounted to a user's finger;

a harness capable of releasably securing a plectrum, the harness hingedly coupled to the ring;

a first spring configured to bias the harness in a stowed position.

2. The apparatus of claim 1, wherein the harness is hingedly coupled to the ring about an axis which is not parallel to a plane defined by the ring.

3. The apparatus of claim 2, wherein the harness is hingedly coupled to the ring about an axis approximately thirty to sixty degrees relative to a plane defined by the ring.

4. The apparatus of claim 2, wherein the spring comprises a hinge integral with the ring and the plectrum module.

5. The apparatus of claim 1, wherein a plectrum secured to the harness is positioned toward a thumb side of the user's finger in the stowed position when the ring is mounted on the user's finger.

6. The apparatus of claim 1, wherein the harness is further capable of being retracted in a deployed position, a plectrum secured to the harness engaged between the user's finger and thumb.

7. The apparatus of claim 1 wherein the harness comprises a first claw portion hingedly coupled to a second claw portion, and a spring biasing the first and second claw portions in a closed position.

8. The apparatus of claim 1 wherein the ring comprises a first arm portion hingedly coupled to a second arm portion, and a spring biasing the first and second arm portions in a closed position.

9. An apparatus comprising:

a ring capable of being releasably mounted to a user's finger;

a plectrum module, the plectrum module hingedly coupled to the ring;

a first spring configured to bias the plectrum module in a stowed position.

10. The apparatus of claim 9, wherein the plectrum module is hingedly coupled to the ring about an axis which is not parallel to a plane defined by the ring.

11. The apparatus of claim 10, wherein the plectrum module is hingedly coupled to the ring about an axis approximately thirty to sixty degrees relative to a plane defined by the ring.

12. The apparatus of claim 9, wherein a plectrum component of the plectrum module is positioned toward a thumb side of the user's finger in the stowed position when the ring is mounted on the user's finger.

13. The apparatus of claim 9, wherein the plectrum module is further capable of being retracted in a deployed position, a plectrum component of the plectrum module engaged between the user's finger and thumb.

14. The apparatus of claim 9 wherein the spring comprises a hinge integral with the ring and the plectrum module.

15. The apparatus of claim 9 wherein the ring comprises a first arm portion hingedly coupled to a second arm portion, and a spring biasing the first and second arm portions in a closed position.

16. An apparatus comprising:

ring means capable of being releasably mounted to a user's finger;

means for hingedly coupling a plectrum to the ring means;

a first spring configured to bias the plectrum module in a stowed position.

17. The apparatus of claim 16 wherein said means for hingedly coupling the plectrum comprises harness means for releasably coupling the plectrum, the harness means hingedly coupled to the ring means about an axis which is not parallel to a plane defined by the ring means.

* * * * *